United States Patent [19]

Beermann

[11] Patent Number: 4,899,443

[45] Date of Patent: Feb. 13, 1990

[54] SAFETY KNIFE FOR CARDBOARD AND LIKE MATERIALS

[75] Inventor: Ewald H. Beermann, Solingen, Fed. Rep. of Germany

[73] Assignee: Martor-Argentax E.H. Beermann KG, Solingen, Fed. Rep. of Germany

[21] Appl. No.: 265,618

[22] Filed: Oct. 31, 1988

[30] Foreign Application Priority Data

Oct. 31, 1987 [DE] Fed. Rep. of Germany ..... 3736968

[51] Int. Cl.[4] ..... B26B 1/08

[52] U.S. Cl. ..... 30/162; 30/2; 30/289; 30/314; 30/329; 30/335

[58] Field of Search ..... 30/162, 335, 2, DIG. 6, 30/DIG. 3, 256, 289, 290, 294, 314, 317, 329, 330, 349, 163; 81/490; 7/167

[56] References Cited

U.S. PATENT DOCUMENTS

| | | | |
|---|---|---|---|
| 2,710,448 | 6/1955 | Andrews | 30/294 X |
| 2,743,523 | 5/1956 | Honey | 30/294 X |
| 3,879,847 | 4/1975 | Roll | 30/162 |
| 4,091,537 | 5/1978 | Stevenson, Jr. | 30/294 X |
| 4,139,939 | 2/1979 | Crooks | 30/2 |

FOREIGN PATENT DOCUMENTS

| | | | |
|---|---|---|---|
| 2736395 | 11/1978 | Fed. Rep. of Germany . | |
| 8628492.4 | 1/1987 | Fed. Rep. of Germany . | |
| 1046 | of 1883 | United Kingdom | 30/163 |
| 14110 | of 1899 | United Kingdom | 30/162 |

*Primary Examiner*—Frank T. Yost
*Assistant Examiner*—Y. Lin
*Attorney, Agent, or Firm*—Herbert Dubno

[57] ABSTRACT

The safety knife comprises a longitudinally slidable knife blade holder spring-loaded in the direction of the knife handle and a holding and guide piece on which the blade holder is engaged. The blade holder and the holding and guide piece on which it is mounted are received slidably and enclosed at least partially by a substantially rectangular-cross sectioned handle sleeve. Side members which are part of the blade holder and which enclose the blade are held on the holding and guide piece under spring tension by a tension spring. They are guided longitudinally slidable by guide ribs which engage in guide grooves in the holding and guide piece. One side member is provide with mounting pins which engage in mounting pin holes in the holding and guide piece for mounting and holding it in place even during blade changing when the other side member is tilted so that the blade is accessible.

15 Claims, 3 Drawing Sheets

SAFETY KNIFE FOR CARDBOARD AND LIKE MATERIALS

FIELD OF THE INVENTION

My present invention relates to a knife and, more particularly, to a safety knife for use in opening cartons or containers made of cardboard or similar materials.

BACKGROUND OF THE INVENTION

The safety knife described in German Pat. No. 27 36 395 has a hollow handle body with a longitudinally slidable blade holder spring-loaded in the direction of the hollow knife handle.

The knife can be held in its working position with the blade extended, by an operating handle projecting outwardly, by transverse pressure applied by the thumb.

On release of the handle, the blade holder together with the blade is retracted into the hollow knife handle by a tension spring. This feature provides a substantial degree of safety from injury to the user. However the effort required to perform a blade change in a limited time interval requires improvement. This process should be performed more quickly than in the prior art safety knife. Also the construction of the known knife is relatively expensive so that it can only be used in advantageous applications where it has considerable advantage.

OBJECT OF THE INVENTION

It is an object of my invention to provide an improved knife, especially a carton safety knife, in which blade changing may be performed more rapidly without danger.

It is also an object of my invention to provide an improved knife in which blade changing is rapid and safe, which has a simple inexpensive structure and which is useful in a plurality of applications, especially for cutting a carton and the like.

SUMMARY OF THE INVENTION

According to my invention the knife handle comprises a substantially rectangular cross section handle sleeve open at opposite ends, by which a holding and guide piece for the blade holder, which projects at one end beyond the handle sleeve, is received with the blade holder being longitudinally slidable. Thus the blade holder is accessible directly by simply drawing the holding and guide piece from the handle sleeve so that the desired rapid blade change is possible.

Advantageously the blade holder comprises two side members enclosing a blade. These side members guarantee a secure guiding and holding of the blade while the blade is easily accessible and/or replaceable by lifting one side member from the other.

According to an advantageous embodiment a side member of the blade holder has two guide ribs which are received by guide grooves of the holding and guide piece slidably. Tilting the blade holder, which could lead to sticking of the blade and thus to a danger of injury, is thus prevented.

Advantageously one of the guide ribs has a stop which engages in an elongated passage inside the holding and guide piece. This elongated passage bounds the sliding motion of the blade holder. The blade is located in its working position or configuration when the stop rests on the front end of the passage.

According to a special advantageous embodiment of my invention the second guide groove opens at its rear end into the rear portion of the holding and guide piece. This embodiment permits a tilting and/or pivoting of the side member of the blade holder carrying the guide ribs upwardly. In blade replacement it is thus no longer necessary to completely loosen and remove parts of the blade holder. By the tilting or tipping upward of the side member through about 90°, both guide ribs engage in the passages of the holding and guide piece and release the blade which now can be turned or replaced. After folding the side member back the blade is secured and after pushing it into the handle sleeve the knife can be used once again.

According to another feature of my invention the second side member located opposite the side member carrying the guide ribs has a plurality of mounting pins directed in the insertion direction which engage in mounting pin holes in the holding and guide piece. In tilting of the side member carrying the guide ribs, the second side member is held fixed on these mounting pins, with the tension spring engaged eccentrically in its position, so the blade changing proceeds as intended. The holding and guide piece forms a rigid unit with the second side member in this position so that upon blade replacement the blade can contact on this second side member. If that were not so there would be a danger of folding up under the action of the tension spring. Advantageously the mounting pins and the mounting passages are shorter than the guide ribs of the side members.

A side member of the blade holder according to an advantageous embodiment of my invention has a retaining projection for the tension spring on a protruding tongue piece which is located in a longitudinal spring groove of the holding and guide piece which has for its part the opposite retaining projection for the spring in an end opposite the projection on the side member. Thus the spring is gripped on three sides by the holding and guide piece and hence its operation is protected.

The retaining projection of the side member for the spring is overlapped or partially surrounded by a recess in another tongue piece provided suitably on the opposing side member. The sliding off of the spring is thus prevented and its reliable mounting is guaranteed.

The side members of the blade holder advantageously have an exterior contour or profiling which make the shift into the operating configuration easy. The holding and guide piece can be provided on a portion protruding out from the handle sleeve with a gripping depression which simplifies the withdrawal of the knife from the gripping sleeve. The gripping sleeve itself can advantageously be made from a substantially rectangular sheet metal blank and have on its end two gripping cut out portions located on opposite sides from each other for the blade holder.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
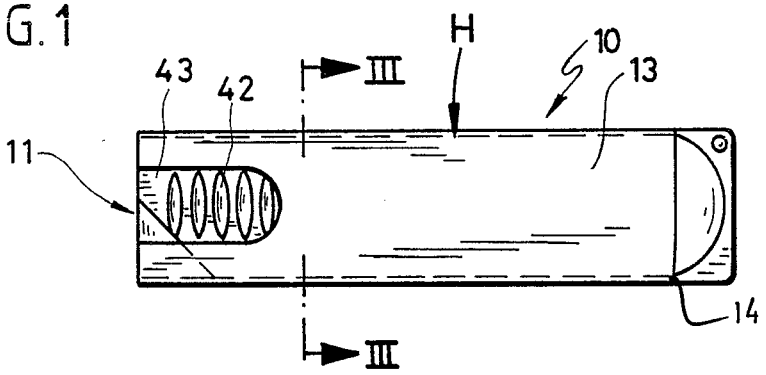
FIG. 1 is a side elevational view of a knife according to my invention in a resting configuration.
Figure 2:
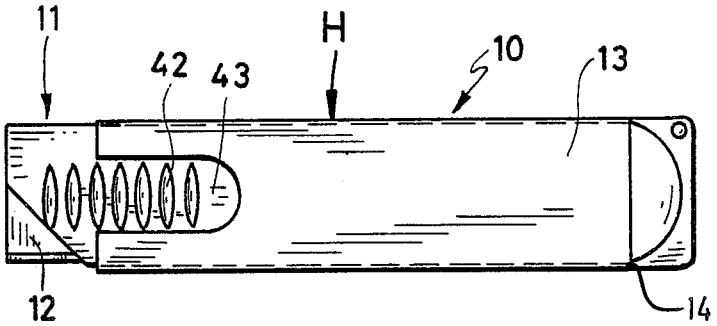
FIG. 2 is a side elevational view corresponding to that of FIG. 1 showing the knife in an extended working configuration.

FIGS. 1 and 2 provide side views of the knife 10 as a whole in its resting configuration and in its working configuration.

With the help of a structure to be described in detail below blade holder 11 with the blade 12 received by it may travel out against the pull of a spring 31 from the handle sleeve 13. The knife 10 is then in the working configuration shown in FIG. 2.

Spring force and automatic locking are allowed to adjust themselves so that the knife during the cutting process—conditioned by the cutting resistance acting against the spring restoring force—remains in the working configuration and at once springs back into the handle sleeve 13 after unloading at following cutting. Satisfactory action and at the same time the desired high degree of safety from injury to the operator are guaranteed.

Figure 3:
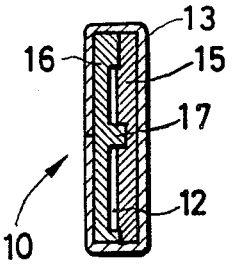
FIG. 3 is a cross sectional view through the knife taken along the line III—III of FIG. 1.

FIG. 3 shows with the aid of a cross sectional illustration the mounting of the blade 12. A first and a second side member 15 and/or 16 enclose the blade 12 and are engaged with each other. Positioning projections 17 provided on the second side member 16 engage holes in the blade 12 and rest and engage in corresponding recesses 35 in the first side member 15. Both side members 15 and 16 are received slidably by the handle sleeve 13.

Figure 4:
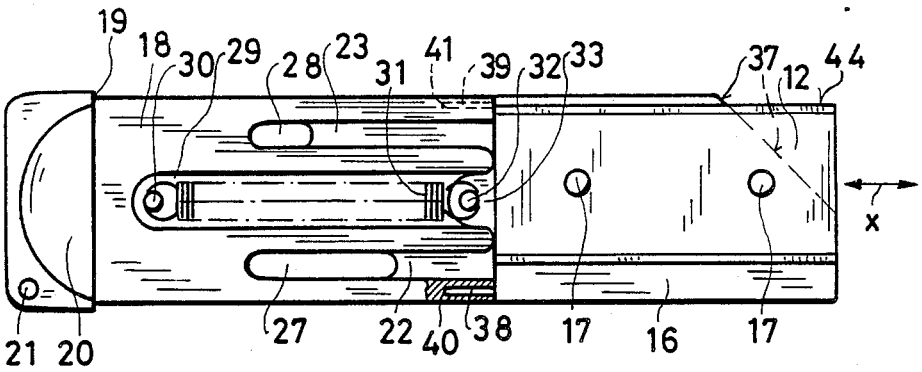
FIG. 4 is a side view of knife of FIG. 1 with the handle sleeve removed and with a first side member of the knife holder taken off.
Figure 5:
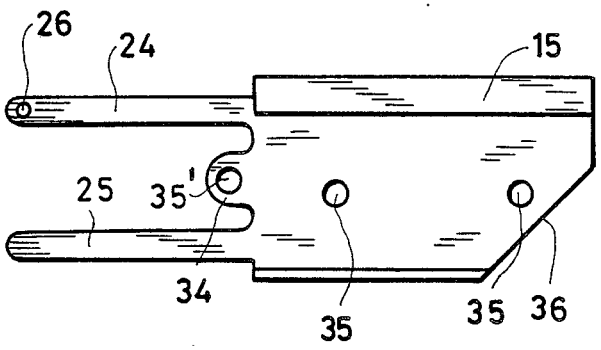
FIG. 5 is a side view of the first side member.

The structure of the knife is described below in greater detail with reference to FIGS. 4 and 5:

FIG. 4 shows the holding and guide piece 18 whose outer shape in the vicinity of the main body of the knife corresponds substantially to the inner dimension of the handle sleeve 13 so that it can be received by it slidably and with frictional resistance to withdrawal. The handle body 14 of the knife handle H comprises the handle sleeve 13. In the rear region the holding and guide piece 18 has a shoulder 19 which braces itself on and forms a stop for the rear end of the handle sleeve 13.

Gripping depressions 20 in holding and guide piece 18 ease the withdrawal of the holding and guide piece 18 together with the blade holder 11 from the handle sleeve 13. A passage 21 on one end of the holding and guide piece 18 acts as a hanging hole or for attachment of a line or cord.

Two guide grooves 23 and 22 are formed with long axes parallel to each other off center in the main part of the holding and guide piece 18. The guide grooves 22 and 23 receive slidably freely projecting guide ribs 24 and/or 25 of the first side member 15 of the blade holder 11. The guide rib 24 carries on its free ends a stop 26 which engages in an oblong or elongated passage 27 forming a lateral cavity in the body of the knife at the rear end of the guide groove 22. This engagement limits the sliding motion of the knife holder 11 illustrated above with the aid of FIGS. 1 and 2 between the resting and the working configurations.

The holding and the guide piece 18 is moreover provided in the sliding direction of the blade holder 11 with a central longitudinal spring groove 29 which has a retaining projection 30 for the tension spring 31 in its rear end. The tension spring 31 is received by the longitudinal spring groove 29.

The opposite end of the tension spring 31 is held on another retaining projection 32 which is carried on a tongue piece 33 which is located centrally on the side of the second side member 16 facing the holding and guide piece 18. A recess 35' is located in a corresponding tongue piece 34 on the opposing side member 15. The recess 35' surrounds an axially protruding portion of the projection 32 of the side member 16 with the knife in the mounted state so that the eye of the tension spring is held securely.

The second side member 16 has a longitudinal depression located somewhat off center to receive the blade 12. Positioning projections 17 of the side member 16 already mentioned in connection with FIG. 3 engage through corresponding holes in the blade 12 and are received by the recesses 35 of the first side member 15. The side member 15 is provided with a somewhat off center longitudinal projection which engages in the longitudinal groove of the opposing side member 16 so that the blade 12 is held positively and is secured. Both side members 15 and 16 have a beveling 36 and 37 on a front corner beyond which the cutting edge 44 of the blade 12 projects so that it can be brought into engagement with the material to be worked.

As is indicted in FIG. 4, the second side member 16 has two mounting pins 39 and 38 on the side facing the holding and guide piece 18 which engage in corresponding mounting pin holes 40 and 41 in the holding and guide piece 18. Because of that and the tension on the spring 31 the second side member 16, also when the first side member 15 is tilted or removed for replacing the blade 12, is fixed to the holding and guide piece 18. Also it is secured against tipping or tilting under the action of the tension spring 31.

Figure 6:
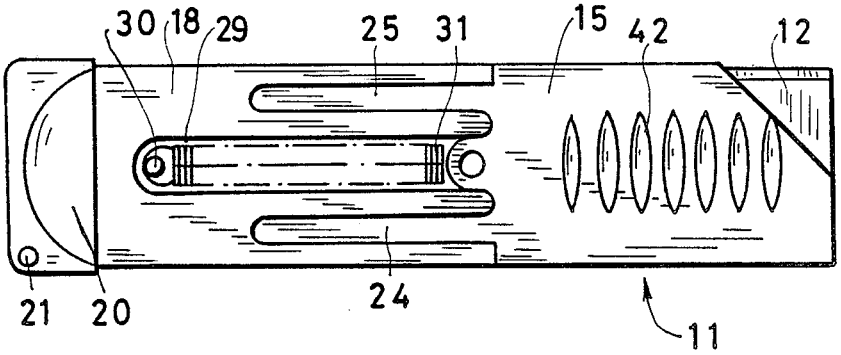
FIG. 6 is a side elevational view corresponding to the illustration of FIG. 4 with the first side member of the blade holder mounted.

FIG. 6 shows the holding and guide piece 18 with the inserted tension spring 31 and with side member 15 mounted. The blade 12 is now enclosed between both side members 15 and 16. Both side members 15 and 16 have profiling or contouring 42 on the outer surface for improved gripping in operation of the knife 10.

The handle sleeve 13 is made from a substantially rectangular cross section sheet metal blank by suitable edge folding. It carries, as is clearly indicted in FIGS. 1 and 2, lateral gripping cutout portions 43 positioned opposite each other in the vicinity of the blade holder 11, through which the profiling of the blade holder 11 can be reached. The handle sleeve 13 can be provided with a shellac or lacquer layer or arbitrarily formed impressions.

Figure 7:
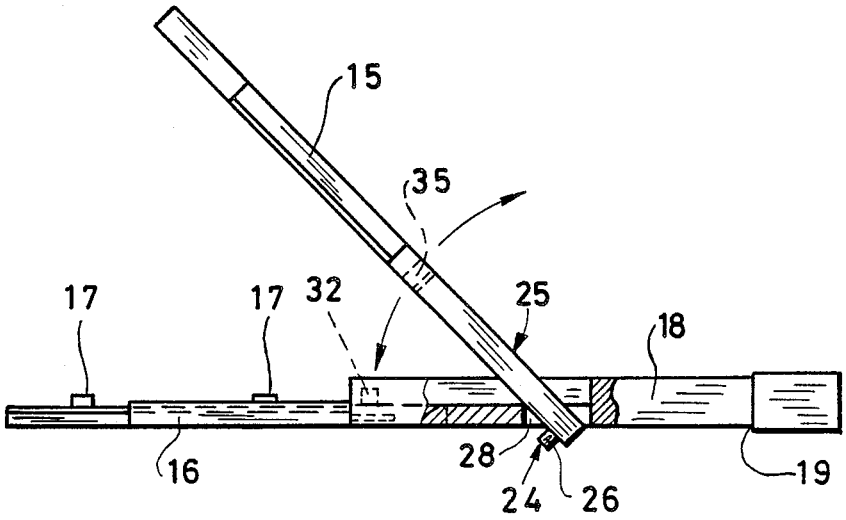
FIG. 7 is a partially top plan, partially cross sectional view of the knife of FIG. 1 in the blade changing configuration.

FIG. 7 shows the holding and guide piece 18 with side member 15 swung out for replacement of the blade 12. The outer end of the guide rib 25 and the corresponding end of the guide rib 24 which can not be seen in the figure penetrate the passages 27 and/or 28 in the guide grooves 22 and/or 23 of the holding and guide piece 18. Thus the side member 15 is held during the blade changing process so that it need not be removed. After complete blade replacement the side member 15 is again swung back and rests positively constrained or guided on the second side member 16 enclosing the blade 12, since the recess 35' surrounds the retaining projection 32 for the corresponding spring eye of the tension spring 31.

It should be expressly noted at this point that in the present description many features are only exemplary and many variations are possible within the scope of my invention.

I claim:

1. A knife, comprising:

a handle sleeve of uubstantially rectangular cross section open at opposite ends;

an elongated stationary holding and guide piece removably received in said handle sleeve, projecting from said handle sleeve at one of said ends, and formed with a longitudinally extending guide;

a blade holder engaging said guide and shiftable in said sleeve, said blade holder being provided with a pair of side members receiving between them a blade lying between said holding and guide piece and the other of said ends, said blade having a cutting edge extending from said blade holder, said sleeve having two opposite sides flanking said members;

a tension spring anchored to said holding and guide piece and connected to said blade holder for automatically retracting said cutting edge into said sleeve; and respective openings formed in said sides of said sleeve and extending inwardly from said other of said ends and through which a finger can be inserted to engage a respective one of said members to press said holder against a force of said spring from said other end of said sleeve and expose said edge for cutting.

2. The knife defined in claim 1 wherein said longitudinally extending guide is comprised of a pair of transversely spaced longitudinal grooves formed in said piece, one of said side members being formed with two guide ribs received in said grooves.

3. The knife defined in claim 2 wherein one of said ribs is formed with a projection at an end thereof and said piece has a slot receiving said projection and engaged thereby at an end of the slot to form a stop for said holder.

4. The knife defined in claim 1 wherein one of said side members has pins extending in a direction of displacement of said holder and received in bores of said piece open in the direction of said holder.

5. The knife defined in claim 4 wherein said longitudinally extending guide is comprised of a pair of transversely spaced longitudinal grooves formed in said piece, the other of said side members being formed with two guide ribs received in said grooves.

6. The knife defined in claim 5 wherein one of said ribs is formed with a projection at an end thereof and said piece has a slot receiving said projection and engaged thereby at an end of the slot to form a stop for said holder.

7. The knife defined in claim 5 wherein said pins and said bores are shorter than said ribs and said grooves.

8. The knife defined in claim 7 wherein said piece is formed with a further groove receiving said spring, said one of said side members having a lug adapted to project into said further groove and provided with a pin engaged by said spring.

9. The knife defined in claim 8 wherein the other of said side members is provided with a respective lug overlying said lug of said one of said members and provided with a hole traversed by said pin engaged by said spring.

10. The knife defined in claim 9 wherein said members have profiling on outer surfaces thereof engageable through said openings.

11. The knife defined in claim 10 wherein said sleeve is bent from a rectangular piece of sheet metal.

12. The knife defined in claim 1 wherein said piece is formed with a groove receiving said spring, one of said side members having a lug adapted to project into said groove and provided with a pin engaged by said spring.

13. The knife defined in claim 12 wherein the other of said side members is provided with a respective lug overlying said lug of said one of said members and provided with a hole traversed by said pin engaged by said spring.

14. The knife defined in claim 1 wherein said members have profiling on outer surfaces thereof engageable through said openings.

15. The knife defined in claim 1 wherein said sleeve is bent from a rectangular piece of sheet metal.

* * * * *